US009802135B2

(12) United States Patent
Caudill

(10) Patent No.: US 9,802,135 B2
(45) Date of Patent: Oct. 31, 2017

(54) SLOT CAR DRAG RACING REACTION START TIMER DEVICE

(71) Applicant: Wes Caudill, Clarkston, MI (US)

(72) Inventor: Wes Caudill, Clarkston, MI (US)

( * ) Notice: Subject to any disclaimer, the term of this patent is extended or adjusted under 35 U.S.C. 154(b) by 205 days.

(21) Appl. No.: 14/540,087

(22) Filed: Nov. 13, 2014

(65) Prior Publication Data

US 2015/0141158 A1 May 21, 2015

Related U.S. Application Data

(60) Provisional application No. 61/904,627, filed on Nov. 15, 2013.

(51) Int. Cl.
*A63H 18/00* (2006.01)
*A63H 18/02* (2006.01)

(52) U.S. Cl.
CPC ..... *A63H 18/026* (2013.01)

(58) Field of Classification Search
CPC ..... G07C 1/24; A63H 17/008; A63H 18/005; A63H 18/026; B60Y 2200/114
See application file for complete search history.

(56) References Cited

U.S. PATENT DOCUMENTS 5,435,553 A * 7/1995 Arima ..... A63G 25/00 273/442
7,086,922 B2 8/2006 Delgado
7,474,984 B2 1/2009 Freifeld
2004/0156467 A1* 8/2004 Freifeld ..... A63H 18/005 377/100
2004/0198168 A1* 10/2004 Delgado ..... A63H 18/002 446/444

* cited by examiner

*Primary Examiner* — Dmitry Suhol
*Assistant Examiner* — Ankit Doshi
(74) *Attorney, Agent, or Firm* — Harpman + Harpman

(57) ABSTRACT

A slot car drag racing reaction start timer assembly that can be mounted on a variety of different slot car tracks. The reaction start timer tower provides for a full drag racing staging and starting light Christmas tree assembly which is electronically linked to car activated optical emitter and sensor combinations from an overhead start gate and timer bridge and the individual driver's car controllers in an electronic integrated timing and reaction circuit. The start tower assembly provides for electronic on-line linking to a use access website to afford multiple racer participation in competition.

5 Claims, 3 Drawing Sheets

SLOT CAR DRAG RACING REACTION START TIMER DEVICE

This application claims the benefit of U.S. Provisional Application No. 61/904,627, filed Nov. 15, 2013.

BACKGROUND OF THE INVENTION

1. Technical Field

This invention relates to model slot cars and racing tracks in which electrically powered slot cars are independently controlled on a track having a guide and power slot within. There are different slot car sizes and tracks currently available and a number of timing systems associated with lap time and start and finish configurations.

2. Description of Prior Art

Prior art devices of this type have all been directed to dedicated drag racing start and finish time slot car track assemblies and timed racetracks. Such drag racing slot cars can be staged and raced on the track having a starting and finish line with means to indicate the winner. Such model car drag racing or actual drag car racing success relies heavily on the reaction time of the "driver", controller operator who must watch the start light sequence and then react as quick as possible thereto by activating their remote throttle switch controller for their respective slot car positioned on the start line without over-reacting and starting before the light sequence has completed. As such, the reaction time, the time between when the start light is illuminated and when the slot car actually moves away from the start line is critical and measured in the hundredth of seconds. A fast reaction time may assure a win with all other elements being equal.

Such prior art model slot car drag racing starting lights and electronic timers have been developed requiring a dedicated drag racing track specifically for designated slot cars to be raced. Such model racing track timers can be seen, for example, in U.S. Pat. Nos. 7,474,984 and 7,086,922.

U.S. Pat. 7,086,922 discloses a track for model cars for "drag racing" having an air powered drive system and a starting light pole to indicate the start of the race.

U.S. Pat. 7,474,984 claims a race course with multiple sensors to identify the racing vehicles determining and displaying their lap time.

SUMMARY OF THE INVENTION

A universal slot car drag racing reaction start timer and communications assembly that provides a universal time starter bridge that has a sequential drag racing timing start and stop light referred to as a Christmas tree and a reaction time display and false start lights. Adjustable multiple optical laser emitters and tuned sensors for each car provide starting car movement orientation fed back to indicate actual start time in comparison to start lights with calculating display reaction time for each car independently in a specific lane at the start of the race.

DETAILED DESCRIPTION OF THE INVENTION

Figure 1:
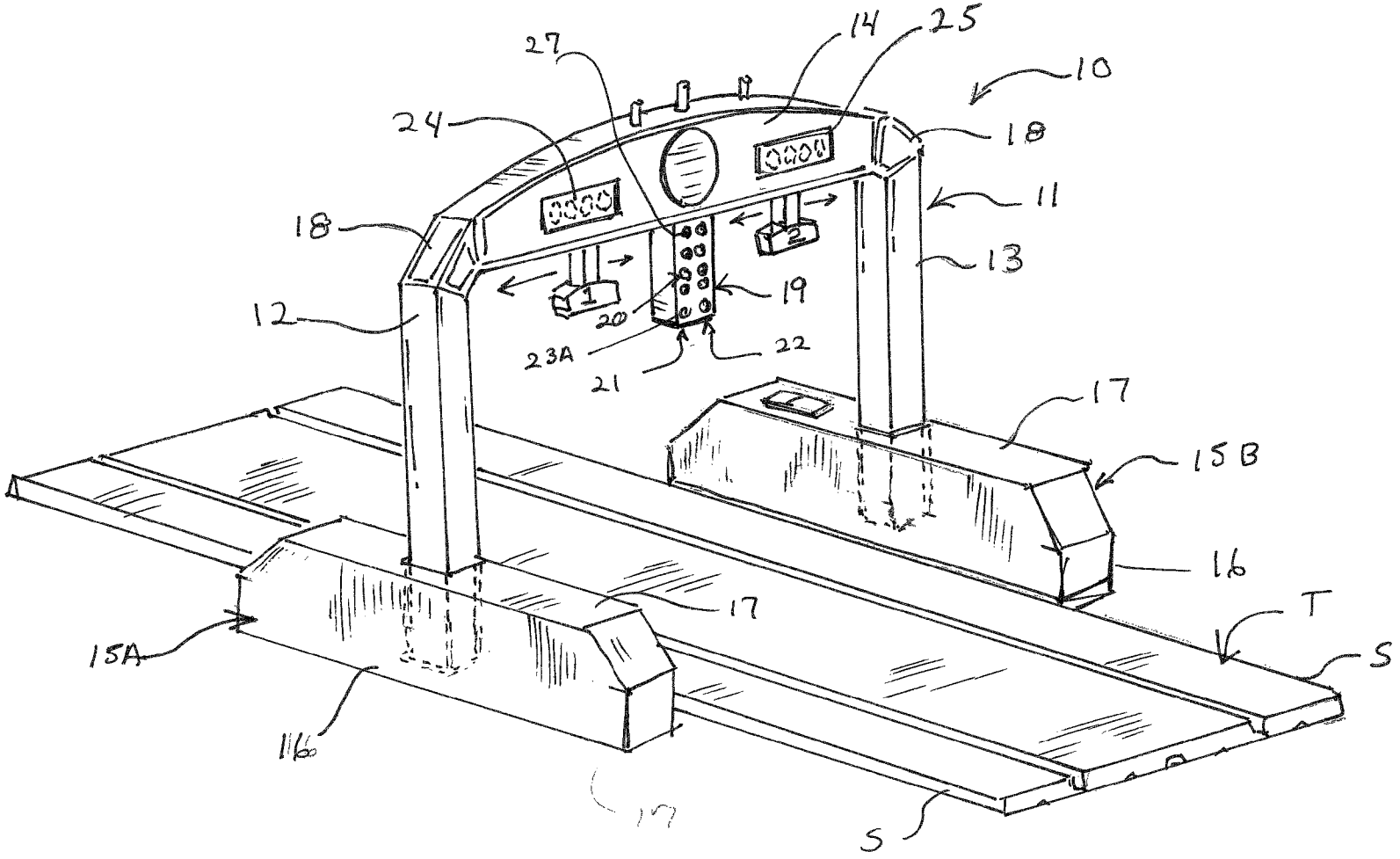
FIG. 1 is a perspective view of the slot car drag racing timer bridge assembly.
Figure 2:
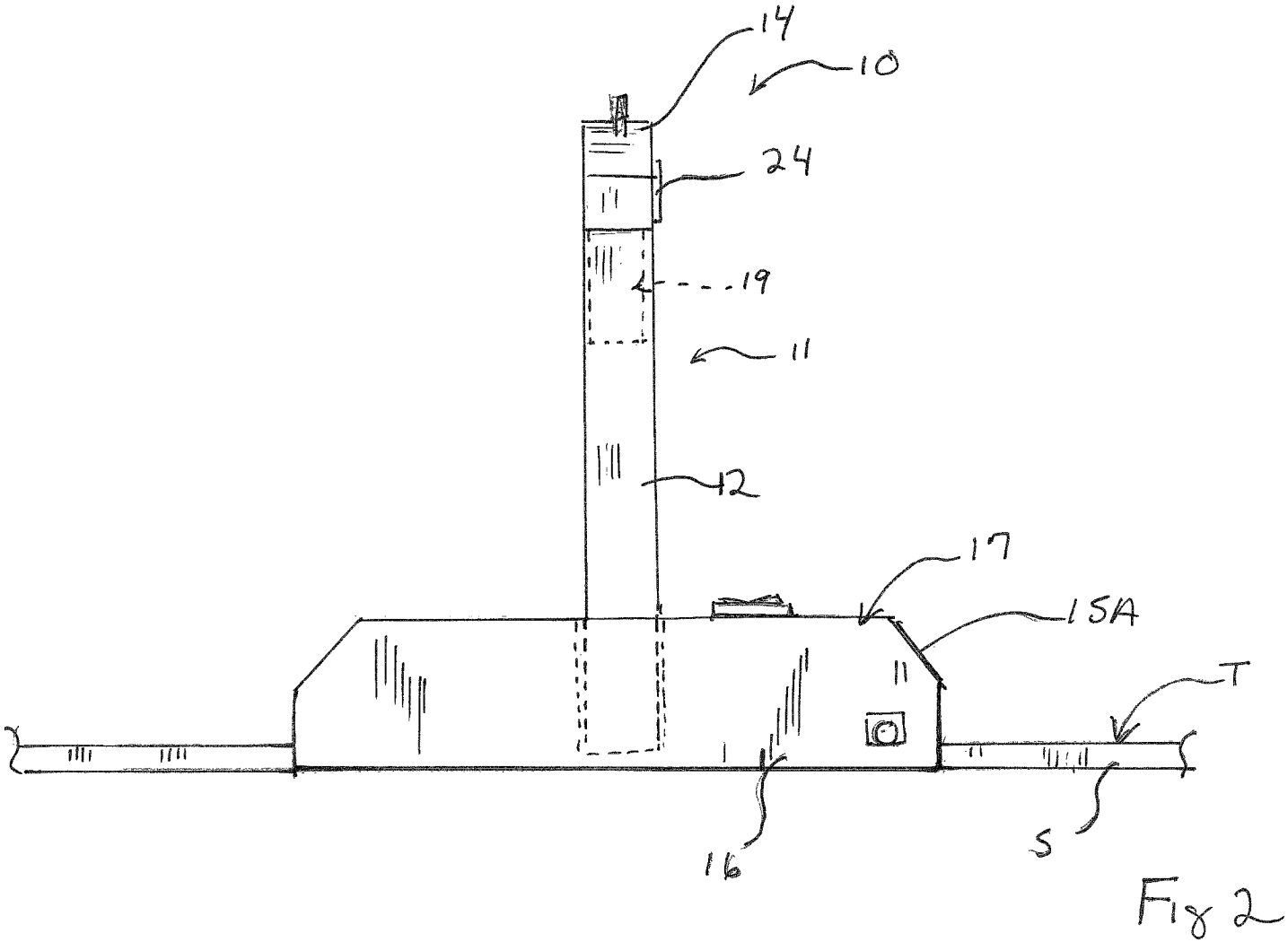
FIG. 2 is a side elevational view thereof.
Figure 3:
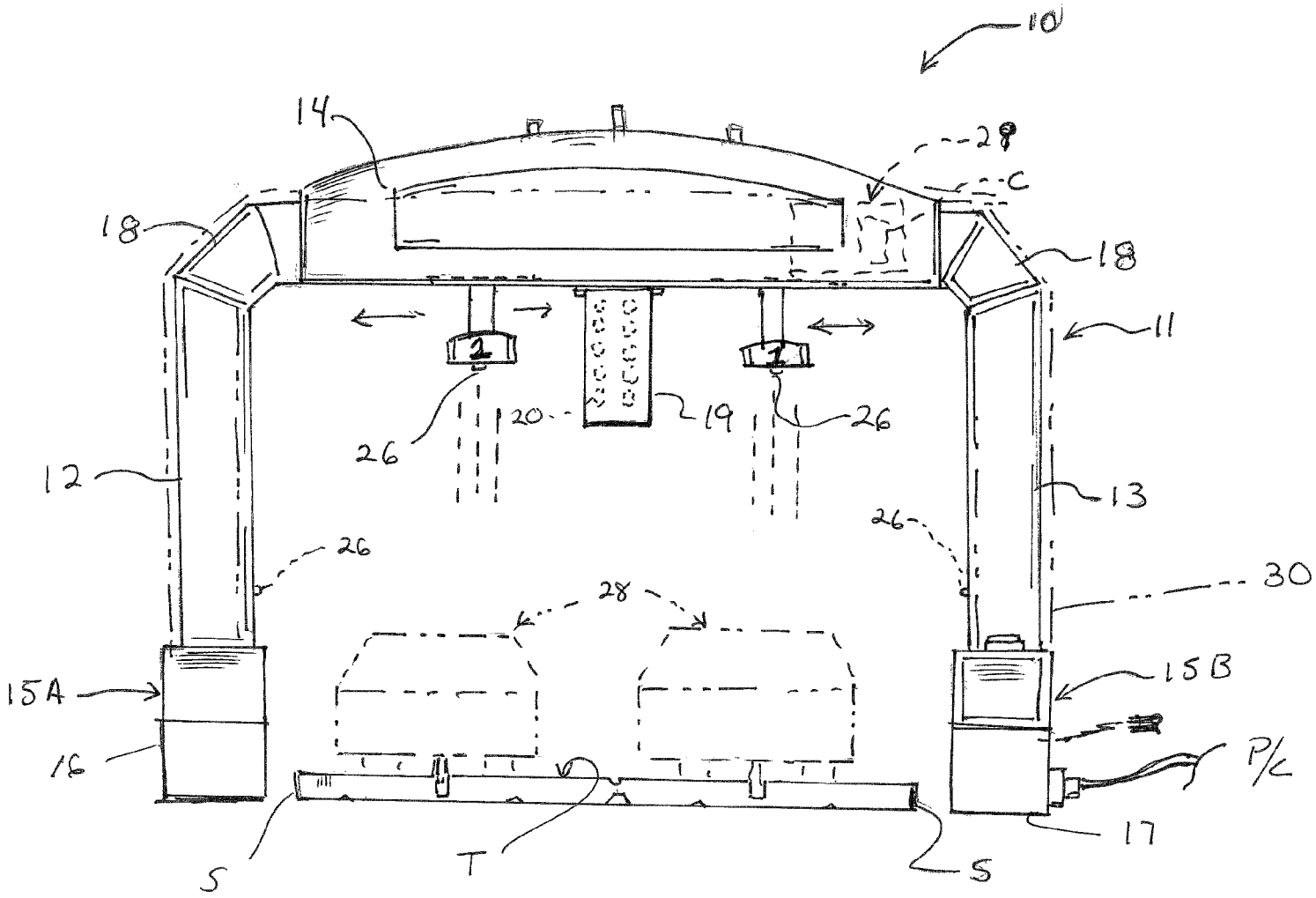
FIG. 3 is a rear elevational view thereof.

Referring to FIGS. 1, 2 and 3 of the drawings, a drag racing reaction timer and start light display 10 of the invention for use with existing slot car racing tracks can be seen. The reaction starting timer 10 has a support bridge assembly 11 with a pair of spaced parallel columns 12 and 13 with interconnecting timer light bridge support 14 there between. Each of the columns is telescopically slidably disposed within respective wall support sections 15A and 15B that provide for vertical stability of the columns and have an enlarged lower portion 16 and an upstanding integral wall portion 17 and are of a sufficient dimension to provide stability to the bridge columns when inserted.

The base and wall portions 16 and 17 for each of the columns 12 and 13 allow for configuration selective registration with corresponding oppositely disposed sides S for a variety of different dimensional slot car race tracks T there between during use as best seen in FIG. 1 of the drawings.

The interconnecting bridge support 14 extends from respective tops 18 of each of the columns and has an enlarged contoured elongated center section from which a starting light display 19 depends midway thereon. The columns 12 and 13 are preferably formed from generally cross-sectionally square tubular molded elements to form structural rigidity, but may be of any other structural consideration capable of elevated cross-track support well within the province and confines of those known within the art.

The staging and starting light display 19 has a plurality of starting lights 20 extending therefrom in two spaced parallel adjacent columns 21 and 22.

The starting light display 19 is thus configured to form a traditional drag racing Christmas tree in which sequential lights are illuminated upon staging the vehicle and then rapidly counting down in light sequence to a start light 23A at which time the respective vehicle drivers can accelerate from the starting line.

A pair of digital reaction time lane displays 24 and 25 are positioned within the enlarged central portion of the support bridge on oppositely disposed sides of the starting light display 19 and will indicate digitally the respective starting times of each of the driver's not shown during operation which is defined as the time between in the starting light display 19 indicates the final start light 23A and when the driver actually starts the respective slot cars positioned on the slot car track by activating their remote throttle control switch, not shown, that regulates the electric power of the respective slot car receives and/or demands depending on the system used.

The digital numerical reaction time displays 24 and 25 and the starting light display 19 therefore are interconnected within an electronic control and timing circuit C that allows each driver to control the respective slot cars independently and accordingly calculates the time sequences associated therewith. To achieve such calculation and timing of reaction time which is measured in the hundredth of seconds a plurality of optical laser emitters and tune sensor assembly pairs 26 are adjustable on the bridge 14 and/or columns 12 and 13 and are interconnected to the control and command circuit C with each of the emitter sensor pairs 26 providing independent information activation sequence to a logic timing controller in the circuit C. It will be evident that the adjustable placement of the optical emitter and sensor pairs provides for many configurations and placement within the confines of the disclosed system so as to support proper orientation detection of slot cars positioned on a variety of track configurations.

Such systems accommodate different lanes with different width configurations to the confines of a variety of different slot car tracks and slot car scales currently available.

The optical emitter sensor pairs 26 can therefore detect the initial movement of the slot cars 28 shown graphically by broken lines in FIG. 3 of the drawings, thus triggering the logic timing controller associated therewith in the control circuit C and afford a calculation of time between the activation of the final staging light 23A and the optical sensors to afford an effective reaction time as illustrated in the respective displays.

It will be evident from the above description that a controlled circuit housing 29 will be provided and integrated within the support assembly 14, best seen in FIG. 3 of the drawings, and provides for containment and mounting of electronic components and associated circuit cars for the control and timing circuit C. It will be evident from the above description that by use of the drag racing reaction timer and starting light assembly 10 of the invention, that slot car drag racing reaction times can be accurately determined and displayed as well as an indication via warning lights 27 that the driver jumped or started before the sequential starting light 23A was illuminated.

As noted, electronic activation and control circuit used may have a static or wireless interface with the internet and a proprietary website, not shown, that can provide each driver a real-time on-line electronic display so mutual drivers can compete against one another in cyberspace on-line.

The drag racing reaction timer and support bridge assembly 11 can therefore provide a unique universal accessory for multiple slot car tracks and combined with a finish line configuration 30, shown in broken lines in FIG. 3 of the drawings, of a similar construction also provides start and finish control aspects for both drag racing within the slot car confines and regular slot car racing wherein multiple laps are achieved.

It will therefore be apparent to those skilled in the art that various changes and modifications may be made thereto without departing from the spirit of the invention.

Therefore I claim:

1. A powered model slot car start timer comprising, a track, a pair of lanes on said track, at least one tower and a bridge support extending from said tower across said track, a starting and staging light display on said bridge, a pair of lane timer displays on said bridge, a pair of optical sensors on said bridge above said respective lanes for detecting and registering model car movement within a track lane, a timer control circuit in communication with a timer display and power controller for model cars on said track, a source of power for said start timer.

2. The powered model slot car start timer set forth in claim 1 wherein said optical sensors are adjustably mounted on said bridge over said lanes.

3. The powered model slot car start timer set forth in claim 1 wherein said starting and staging lights display comprises, multiple light columns, comprising staging lights, starting lights, and warning lights.

4. A powered model slot car start, staging and elapsed timer comprising, a pair of towers and tower wall supports, a bridge support extending between said towers over track lanes, a starting and staging light display on said bridge comprising, multiple light columns, comprising staging lights, starting lights, and warning lights, a pair of track lane reaction starting and elapsed timer displays on said bridge, optical lane sensors on said bridge for detecting and communicating power model car movement over said respective track lanes, a light and timer electronic control circuit in communication with said light and timer displays, optical lane sensors and a model car power controller.

5. The powered model slot car start, staging and elapsed timer set forth in claim 4 wherein said timer comprises, optical sensors adjustably mounted on said bridge.

* * * * *